United States Patent [19]

Ikeda et al.

[11] 4,211,064

[45] Jul. 8, 1980

[54] TIME SIGNAL TIMEPIECE

[75] Inventors: Masayuki Ikeda; Takahiro Naka, both of Suwa, Japan

[73] Assignee: Kabushiki Kaisha Suwa Seikosha, Suwa, Japan

[21] Appl. No.: 944,158

[22] Filed: Sep. 20, 1978

[51] Int. Cl.[2] ..... G04B 21/08; G04C 21/00

[52] U.S. Cl. ..... 368/272; 368/259; 368/273

[58] Field of Search ..... 58/16 R, 19 R, 12–14, 58/21.12, 38 R, 38 A, 39, 152 B; 340/384 R, 384 E, 392

[56] References Cited

U.S. PATENT DOCUMENTS

| | | | |
|---|---|---|---|
| 3,728,855 | 4/1973 | Preiser | 58/38 |
| 4,055,843 | 10/1977 | Whitaker | 340/384 E |
| 4,073,133 | 2/1978 | Earls et al. | 58/13 |
| 4,090,349 | 5/1978 | Takase | 58/12 |
| 4,098,071 | 7/1978 | Kawarami et al. | 58/39 |

*Primary Examiner*—Vit W. Miska

[57] ABSTRACT

A time signal timepiece has a timekeeping portion and an electronic sound generating portion. The electronic sound generating portion comprises two counters, two oscillator circuits and a coincidence circuit. The hour signal from the timekeeping portion makes the first oscillator circuit oscillate. The first counter counts the number of hour signals. The second counter counts the number of signals from the first oscillator circuit which determines an interval of a time signal sound. The coincidence circuit has a function to stop an oscillation of the first oscillator circuit by detecting a coincidence of contents of the first counter with that of the second counter. The signal from the first oscillator circuit actuates the second oscillator circuit which determines the frequency of the time signal sound. The second oscillator circuit then generates the number of signals corresponding to the present time and having predetermined interval and frequency.

2 Claims, 2 Drawing Figures

TIME SIGNAL TIMEPIECE

BACKGROUND OF THE INVENTION

Almost all the conventional time signal timepieces use metallic poles and hammers in the time signal sound generating portion. Furthermore, in the conventional time signal timepiece, counting of the number of striking for time signal is done by the mechanical mechanism for counting the number of striking. These facts prevent the timepiece from being made small-sized and light-weighed. The mechanical mechanism for counting the number of striking needs many parts such as a motor, mechanical contacts, wheels, levers, etc., and moreover, these parts are required to complicatedly combine, which are factors of reduction in reliability and increase of the cost as well as prevents the timepiece from being made small-sized and light-weighed. Especially in a time signal timepiece wherein the time signal sound generating portion consists of an electronic circuit and an electro-acoustic transducer, leaving the mechanical mechanism for counting the number of striking brings the above-mentioned faults and excludes the meaning of electrical operation of the time signal sound generating portion. That is, it doubles the trouble of possessing both mechanical mechanism for counting the striking number and the electronic circuit for generating the time signal sound. And the effective use of the electrical operation over counting of the striking number and generating of the sound is arrested.

SUMMARY OF THE INVENTION

As shown in and after FIG. 2, in this invention, the number of mechanical contacts which are necessary for input signals from the timepiece is decreased as much as possible, and the electronic sound generator is actuated by operating electronic counter circuit, oscillator circuit, modulator and electro-acoustic transducer.

This invention relates to a time signal timepiece having a time signal function.

An object of this invention is to make the time signal timepiece small-sized and light-weighed.

The other object is to improve the reliability with respect to time signal and to lower the cost of the time signal timepiece.

DESCRIPTION OF THE PREFERRED EMBODIMENTS

Figure 1:
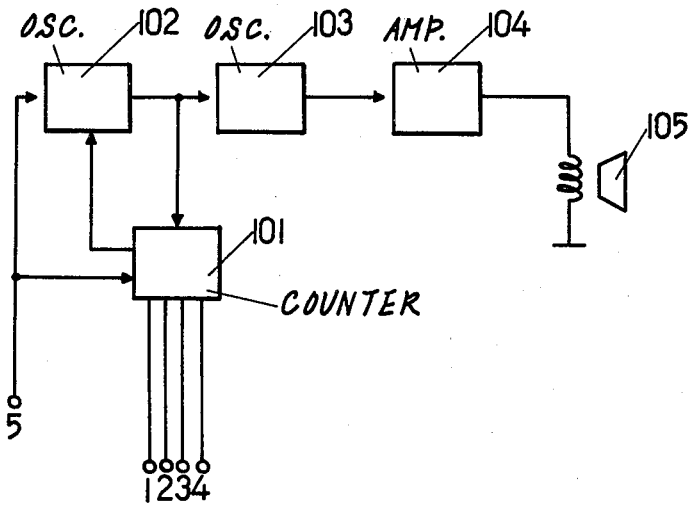
FIG. 1 PRIOR ART
FIG. 1 is a block diagram showing a structure of a conventional time signal timepiece.

In FIG. 1, which shows a conventional construction, a presettable counter 101 is provided with input terminals 1 to 4 to which preset signals are applied. Decimal numbers 1 to 12 are transformed into binary code, and then they are applied to the input terminals 1 to 4 from contacts of a rotary switch interlocking with hour hand of the timekeeping portion. At the time to be informed, the trigger signal is applied to a terminal 5 from the timekeeping portion and it operates an oscillator circuit 102 which determines the number of striking, and then the signal from the oscillator circuit 102 is input to the counter 101 and it stops the actuation of the oscillator circuit 102 when the number of the output of the oscillator circuit 102 reaches a preset value determined by input terminals 1 to 4.

Also, the signal from the oscillator circuit 102 operates an oscillator circuit 103 which determines the frequency of time signal sound; and the signal from the oscillator circuit 103 is applied to an electro-acoustic transducer 105 through an amplifier circuit 104 and then is made into time signal sound, so that the time signal sound having the number of striking determined by the preset value is emitted. However, such a method as shown in FIG. 1 has to deal with five kinds of signals which are applied from the timekeeping portion in total: four kinds of preset signals which are applied to the counter 101 from the hour hand and one kind of signal generated at the time to be informed. Therefore, if the construction as shown in FIG. 1 is used, the mechanical part forming the timekeeping portion has a complicated construction and the more contacts the mechanical part is provided with, the more the reliability is lowered. Besides, since the number of pins of an integrated circuit is increased when a time signal sound generating portion is integrated, the integrated circuit as well as the timekeeping portion become more expensive to produce.

This invention eliminates the above-mentioned faults. The following is the explanation of this invention.

Figure 2:
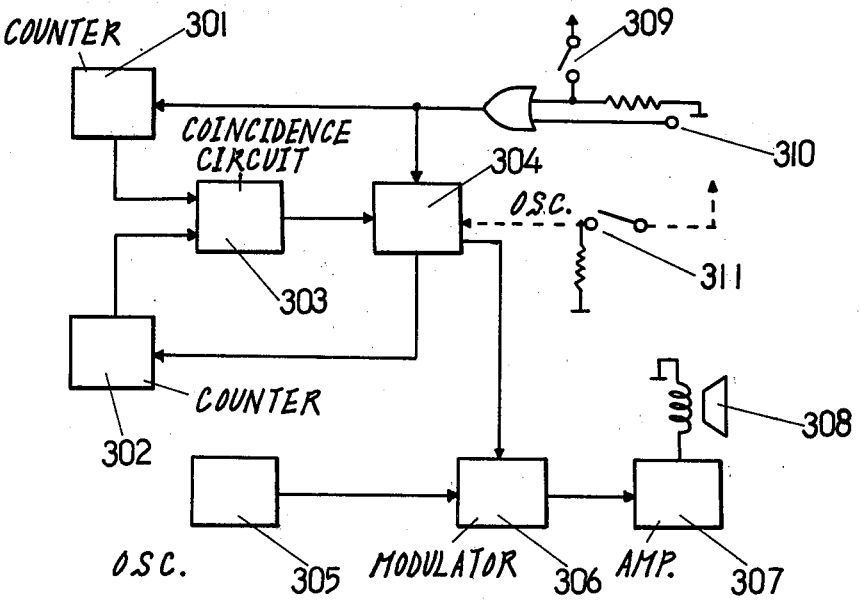
FIG. 2 is a block diagram showing an embodiment of a time signal timepiece according to this invention.
Figure 3:
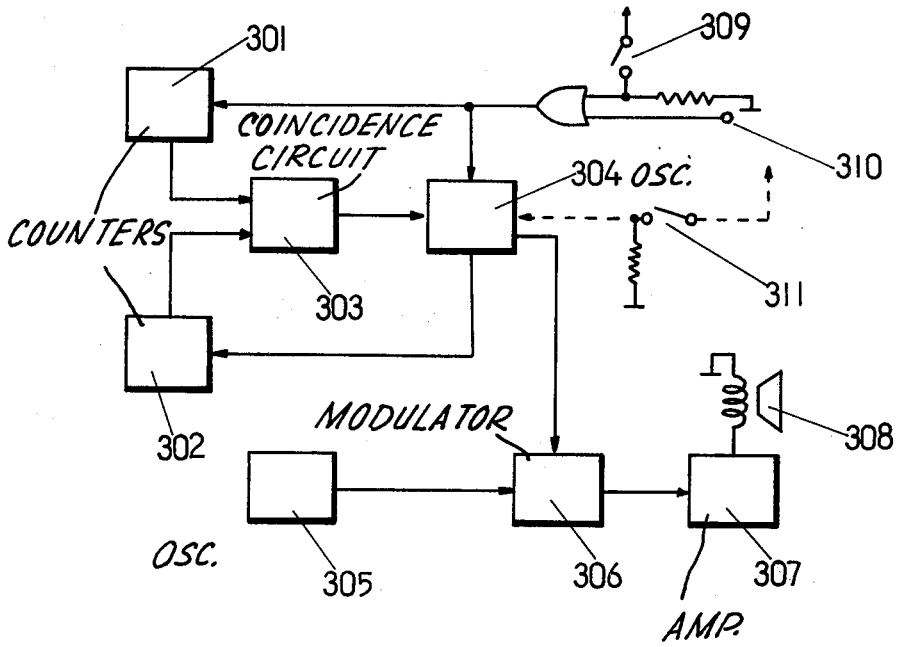

FIG. 2 shows an embodiment of the time signal timepiece in accordance with this invention. The timekeeping portion (not shown) generates a signal every hour (for example, 1:00, 2:00, etc.) or every thirty minutes by detecting the position of the minute hand. The signal generated at the time to be informed is applied to a deodecimal counter 301 which counts the numbers 1 to 12 from a terminal 310. The signal from a switch 309 to correct externally contents of the counter 301 is also applied to the counter 301. Once the time and the contents of the counter 301 are made to coincide to each other by the switch 309, the contents of the counter 301 always coincide with the present time (hour) by the signal from the timekeeping portion. These signals from the terminal 310 or the switch 309 make an oscillator 304 output a signal which determines the interval of the sound for informing the time. A counter 302 counting from 1 to 12 counts the number of signals from the oscillator circuit 304 while time signal sound is generated. The signal from the oscillator circuit 304 being counted by the counter 302, if both contents of the counter 301 and that of the counter 302 are coincident with each other, stop signals are output from the oscillator coincidence circuit 303, so that a circuit 304 for producing trigger pulses of time signal sound is stopped. By this construction, the time signal sound the number of which corresponds to the present time is generated, i.e. it is generated once at one o'clock, three times at three o'clock and so on. Signals from oscillator circuit 305 which determines the frequency of time signal sound are applied to a modulator 306. The modulator 306 modulates the signal from the oscillator circuit 305 and determines the number of the signal for time information according to the signal from the oscillator circuit 304. The output signal from the modulator 306 are emitted to the outside as time signal sound passing through an amplifier portion 307 and an electro-acoustic transducer 308.

In the embodiments of time signal timepiece according to this invention, only a signal for detecting the time to be informed is supplied from a timekeeping mechanism, whereby the mechanism of timekeeping portion can be made remarkably simple as compared with the method shown in FIG. 1. Further, since the contacts in mechanical portion decreases to 1/5, reliability is extremely improved. The time signal sound generating portion is made up of electronic circuit, a time signal counting circuit which mainly has a counter is provided, the mechanism of timekeeping portion is made simple, and the number of input terminals is reduced when the circuit is integrated in accordance with the decrease of the number of input signals into the electronic circuit. In consequence, it can be achieved to make a timepiece small-sized and light-weighed, and the timepiece can be realized at low cost. However, in the time signal timepiece according to this invention, the time shown by hands and the contents of the signal counting circuit are not generally coincident with each other in an initial stage after battery change.

Accordingly, it is necessary to coincide the contents of the time signal counting circuit with the time shown by hour hand, by manually operating the switch 309. Although the necessity of correcting such disagreement is a fault of the time signal timepiece according to this invention, it is required only at the time of purchase and of battery change. So, such disagreement is required to be corrected at most once a year, which does not interfere with the use of the timepiece. Further, since the time signal sound is simultaneously emitted when the switches are operated, the disagreement can be corrected on hearing the time signal sound, and therefore, the timepiece can be immediately set in normal condition by only operating the switch.

The portion shown by broken line in FIG. 2 is a monitor portion provided in order to know the contents of the time signal counting circuit, and by operating the switch 311, it is possible to hear the monitor sound which informs a person of the contents of the time signal counting circuit without changing the contents of the time signal counting circuit. Therefore, in case that the contents of the time signal counting circuit are desired to be changed, they can be changed by operating the monitor portion so as to know the contents of the time signal counting circuit, thereafter by inputting the set signal into the time signal counting circuit so as to operate the switch 309 until a desired contents of the time signal counting circuit is obtained.

Although the above-mentioned description about the time signal timepiece according to this invention does not refer to the kind of time signal sound, many kinds of time signal sounds can be adopted since the time signal sound generating portion consists of electronic circuit. For example, it is possible to generate various kinds of acoustic signals such as monotone, sound synthesized by Fourier spectral density, popular time signal sound, melodious time signal sound, high sound, low sound, or sound combined by the above-mentioned.

Although the description about the embodiments according to this invention does not refer to the generation of time signal sound, for example, every thirty minutes, independent of the contents of the time signal counting circuit, in such a case, such a time signal sound can be generated by inputting the trigger signal which generates the time signal sound without having influence on the time signal counting circuit into the time signal sound generating portion. In case that a person is informed of the time, by providing a ½ divider circuit between the input terminal of the counter 301 and an OR gate, and by utilizing the rise and fall of the output of the ½ divider circuit, hour signal can be distinguished from thirty minutes signal, which makes it possible to utilize the same input terminal of the signal to detect the time to be informed to perform both hour signal and thirty minutes signal.

In order to achieve miniaturization of a timepiece and to improve the efficiency in assembling, it is desirable to integrate circuits. In such a case, it is most efficient to make timekeeping portion, time signal counting circuit and time signal sound generating portion into one chip. Contemplating manufacturing process of integrated circuits, the following processes may emerge as possible candidates. That is to say, bipolar manufacturing process, MOS manufacturing process or combined manufacturing process of these two manufacturing processes, by which a part of or the whole electronic circuit is constructed. If the amplifier portion is constructed by bipolar manufacturing process and the other portions are constructed by MOS manufacturing process, an useful integrated circuit which exerts the advantages of both processes is obtained.

What is claimed is:

1. A time signal timepiece having a time-keeping portion for producing a signal every hour and a time signal sound generating portion which consists of a first counter for counting the number of said signals; a first oscillator circuit operated by said signal and determining an interval of a time signal sound; a second counter for counting the number of signals from said first oscillator circuit; a coincidence circuit for stopping an oscillation of said first oscillator circuit by detecting a coincidence of contents of said first counter with that of said second counter; a second oscillator circuit for determining the frequency of the time signal sound; a modulator for modulating a signal from said second oscillator circuit and determining the number of the signals of time information according to the signal from said first oscillator circuit; an amplifier and an electro-acoustic transducer for amplifying the signal from said modulator and generating the time signal sound; and a switch for correcting the contents of said first counter so that it may coincide with the display time of a timepiece.

2. A time signal timepiece as claimed in claim 1, being provided with a switch means for generating the sound to inform the contents of said first counter, said switch means being conncted to said first oscillator circuit and being operative for oscillating said first oscillator circuit by the number corresponding to the contents of said first counter to inform the contents of said first counter.

* * * * *